US005410766A

United States Patent [19]

Schumacher

[11] Patent Number: 5,410,766

[45] Date of Patent: May 2, 1995

[54] AUTOMATIC TOILET FLUSHING APPARATUS

[76] Inventor: Mark A. Schumacher, 2632 E. 22nd St., Farmington, N. Mex. 87401

[21] Appl. No.: 240,163

[22] Filed: May 9, 1994

[51] Int. Cl.[6] ..... E03D 5/04

[52] U.S. Cl. ..... 4/250; 4/408

[58] Field of Search ..... 4/408, 409, 249, 250

[56] References Cited

U.S. PATENT DOCUMENTS

| | | | |
|---|---|---|---|
| 505,601 | 9/1893 | Hankenhof | 4/250 X |
| 591,016 | 10/1897 | Scott | 4/250 X |
| 638,888 | 12/1899 | Schlieder | 4/409 |
| 1,287,113 | 12/1918 | Sager . | |
| 1,313,740 | 8/1919 | Sager . | |
| 1,605,939 | 11/1926 | Haas | 4/250 X |
| 2,200,687 | 5/1940 | Bercot | 4/249 |
| 3,590,397 | 7/1971 | Akamatsu . | |
| 5,054,132 | 10/1991 | Bartella | 4/302 |

FOREIGN PATENT DOCUMENTS

| | | | |
|---|---|---|---|
| 0570823 | 12/1957 | Italy | 4/250 |
| 0000245 | 1/1903 | United Kingdom | 4/409 |

*Primary Examiner*—Charles E. Phillips
*Attorney, Agent, or Firm*—David L. Baker; Rhodes & Ascolillo

[57] ABSTRACT

An automatic toilet flushing apparatus for a toilet having a toilet bowl, a cover member for selectively moving between an open and a closed position with respect to the toilet bowl, a water tank, and a trippable flapper valve for admitting water from the water tank into the toilet bowl when the flapper valve is tripped, the automatic toilet flushing apparatus including an actuating lever pivotally mounted about a first fulcrum, the actuating lever having a first end and a second end, a tripping lever pivotally mounted about a second fulcrum, the tripping lever also having a first end and a second end, a first link connecting the first end of the actuating lever to the flapper valve, a second link connecting the second end of the actuating lever to the second end of the tripping lever, and a tripping mechanism for initially pivoting the tripping lever about the second fulcrum and for thereafter releasing the tripping lever when the cover member is moved to the closed position with respect to the toilet bowl.

14 Claims, 8 Drawing Sheets

AUTOMATIC TOILET FLUSHING APPARATUS

BACKGROUND

1. Field of the Invention

The present invention relates to the field of devices employed for flushing a toilet (or commode).

2. Description of the Related Art

U.S. Pat. No. 5,054,132 relates to a flush control system for a plumbing fixture having electrical components that electrically operate a flush valve, wherein an electrical circuit is activated by lifting a normally closed cover for a predetermined time. When the cover is subsequently lowered, the flush valve is actuated for a second predetermined time.

U.S. Pat. No. 3,590,397 relates to an automatic flushing device for a toilet, wherein the flushing of water is controlled by a switch actuated by a lid, such that, when the lid is opened, a control circuit opens a flush valve for a predetermined period of time to flush the toilet prior to use, and when the lid is closed after use, the control circuit again opens the valve for a predetermined period of time to flush the toilet again.

U.S. Pat. No. 2,200,687 relates to a toilet bowl in which the seat and cover members may be automatically closed under predetermined conditions after being shifted to a raised position, and in which a mechanism is incorporated for coaction with one of the seat and cover members as it is moved to a closed position for actuating the flushing valve of the toilet.

U.S. Pat. No. 1,313,740 relates to a manually operated mechanism for raising the cover of a toilet bowl and for lowering the cover and flushing the bowl, the mechanism including a pivotally mounted and manually operated lever which is connected, through the medium of a bar, to the cover, which lever engages and idly operates a pivoted pawl upon the raising action of the cover, and strikes and operates the pawl in a movement which lowers the cover for operating the flushing mechanism to flush the bowl simultaneously with the lowering of the cover.

U.S. Pat. No. 1,287,113 relates to a toilet flushing mechanism that includes a longitudinally movable bar that is connected to a pivoted cover or seat of a toilet bowl, and a plurality of pawls and levers that are controlled by the depressions of foot rods for moving the bar longitudinally to move the pivoted seat and also to operate the flushing mechanism of the toilet at the time when the seat is started to be moved into a closed position.

SUMMARY OF THE INVENTION

For obvious sanitary reasons, various mechanisms have been proposed for ensuring that a toilet is flushed after use. Some of these mechanisms are discussed above. Some of the known devices employ electrical or electronic circuitry. However, supplying electrical power to such devices may prove difficult and/or require the installation of additional power lines or battery power.

Additionally, some of the devices that have been proposed for automatically flushing a toilet often involve complicated mechanical arrangements that are subject to mechanical failure. Further, such complicated mechanical arrangements can be expensive to manufacture.

Accordingly, one object of the present invention is the provision of an automatic toilet flushing apparatus that functions on a purely mechanical basis and that, therefore, does not require any electrical power.

Another object of the invention is the provision of such an automatic toilet flushing apparatus that is relatively simple in its mechanical structure and operation and that, therefore, substantially reduces the likelihood of mechanical failure.

Yet another object of the invention is the provision of such an automatic toilet flushing apparatus that is inexpensive to manufacture.

In one aspect, the invention generally features an automatic toilet flushing apparatus for a toilet having a toilet bowl, a cover member for selectively moving between an open and a closed position with respect to the toilet bowl, a water tank, and a trippable flapper valve for admitting water from the water tank into the toilet bowl when the flapper valve is tripped, the automatic toilet flushing apparatus including: an actuating lever pivotally mounted about a first fulcrum, the actuating lever having a first end and a second end; a tripping lever pivotally mounted about a second fulcrum, the tripping lever also having a first end and a second end; a first link connecting the first end of the actuating lever to the flapper valve; a second link connecting the second end of the actuating lever to the second end of the tripping lever; and a tripping mechanism for initially pivoting the tripping lever about the second fulcrum and for thereafter releasing the tripping lever when the cover member is moved to the closed position with respect to the toilet bowl.

Preferably, the tripping mechanism includes: a catch member; an outstanding projection provided on the catch member for engaging the first end of the tripping lever; and a third link connecting the catch member and the cover member; the tripping mechanism additionally includes a first biasing mechanism for biasing the catch member in a direction for applying tension to the third link; and the tripping mechanism additionally includes a second biasing mechanism for biasing the tripping lever in a direction for applying tension to the first and second links.

In another aspect, the invention generally features an automatic toilet flushing apparatus for a toilet having a toilet bowl, a cover member for selectively moving between an open and a closed position with respect to the toilet bowl, a water tank, and a trippable flapper valve for admitting water from the water tank into the toilet bowl when the flapper valve is tripped, the automatic toilet flushing apparatus including: an actuating lever pivotally mounted about a first fulcrum, the actuating lever having a first end and a second end; a tripping lever pivotally mounted about a second fulcrum, the tripping lever also having a first end and a second end; a first link connecting the first end of the actuating lever to the flapper valve; a second link connecting the second end of the actuating lever to the second end of the tripping lever; and a tripping mechanism for initially pivoting the tripping lever about the second fulcrum and for thereafter releasing the tripping lever when the cover member is moved to the closed position with respect to the toilet bowl, the tripping mechanism including: a hollow member having a longitudinal axis; a catch member disposed within the hollow member for sliding reciprocation therewithin along the longitudinal axis,; an outstanding projection provided on the catch member for engaging the first end of the tripping lever, the outstanding projection projecting outside of the hollow member; a third link connecting the catch member and the cover member; a spring positioned within the hollow member and urging the catch member along the longitudinal axis of the hollow member; and a biasing mechanism for biasing the tripping lever in a direction for applying tension to the first and second links.

Preferably, the hollow member is provided with an elongated opening extending along the longitudinal axis, and the outstanding projection of the catch member projects through the elongated opening to a point outside of the hollow member and adjacent the first end of the of the tripping lever; the outstanding projection is provided with an upwardly facing engagement surface projecting substantially outward from the hollow member for engaging the first end of the tripping lever; the actuating lever is positioned substantially above the tripping lever, the longitudinal axis of the hollow member is oriented substantially obliquely to the vertical, a first camming surface is provided on the outstanding projection, and a second camming surface is provided on the first end of the tripping lever; the first camming surface includes a surface extending inward toward the longitudinal axis of the hollow member from a point of intersection with the engagement surface and the second camming surface includes an upwardly facing and inwardly tapering surface provided on the first end of the tripping lever; the actuating lever is disposed within the water tank of the toilet; the tripping lever is positioned substantially beneath the cover member of the toilet; the water tank of the toilet includes a pair of opposing substantially vertical walls, and the first fulcrum includes: a rod member for extending between the opposing walls of the water tank; and a securement mechanism for securing the rod member to the opposing walls of the water tank; and the securement mechanism includes a suction cup attached to each of the terminal ends of the rod member.

In yet another aspect, the invention generally features an automatic toilet flushing apparatus for a toilet having a toilet bowl, a cover member for selectively moving between an open and a closed position with respect to the toilet bowl, a water tank, the water tank including a pair of opposing substantially vertical walls, and a trippable flapper valve for admitting water from the water tank into the toilet bowl when the flapper valve is tripped, the automatic toilet flushing apparatus including: an actuating lever pivotally mounted about a first fulcrum, the actuating lever having a first end and a second end; a tripping lever pivotally mounted about a second fulcrum, the tripping lever also having a first end and a second end; the actuating lever being positioned substantially above the tripping lever; the actuating lever being disposed within the water tank of the toilet; the tripping lever being positioned substantially beneath the cover member of the toilet; the first fulcrum including a rod member for extending between the opposing walls of the water tank, the rod member including first and second rod sections, the first and second rod sections being threadingly interconnected, and a suction cup attached to each of the terminal ends of the rod member; a first link connecting the first end of the actuating lever to the flapper valve; a second link connecting the second end of the actuating lever to the second end of the tripping lever; and a tripping mechanism for initially pivoting the tripping lever about the second fulcrum and for thereafter releasing the tripping lever when the cover member is moved to the closed position with respect to the toilet bowl, the tripping mechanism including: a hollow member having a longitudinal axis; the longitudinal axis of the hollow member being oriented substantially obliquely to the vertical; an elongated opening extending along the longitudinal axis of the hollow member; a catch member disposed within the hollow member for sliding reciprocation therewithin along the longitudinal axis,; a spring positioned within the hollow member and urging the catch member along the longitudinal axis of the hollow member; an outstanding projection provided on the catch member for engaging the first end of the tripping lever, the outstanding projection projecting through the elongated opening to a point outside of the hollow member and adjacent the first end of the of the tripping lever; the outstanding projection being provided with an upwardly facing engagement surface projecting substantially outward from the hollow member for engaging the first end of the tripping lever; a first camming surface is provided on the outstanding projection, the first camming surface including a surface extending inward toward the longitudinal axis of the hollow member from a point of intersection with the engagement surface a second camming surface is provided on the first end of the tripping lever, the second camming surface including an upwardly facing and inwardly tapering surface provided on the first end of the tripping lever; a third link connecting the catch member and the cover member; and a biasing mechanism for biasing the tripping lever in a direction for applying tension to the first and second links.

Preferably, the first link includes a chain; the second link includes a bar member pivotally connected to both of the second ends of the actuating and tripping levers; the third link includes a flexible cord extending between the catch member and the cover member of the toilet; and the first link additionally includes an arm member pivotally connected to the first end of the actuating lever, the chain extending between the arm member and the flapper valve.

The invention will now be described by way of a particularly preferred embodiment, reference being made to the accompanying drawings, wherein:

DESCRIPTION OF THE PREFERRED EMBODIMENT

Figure 1:
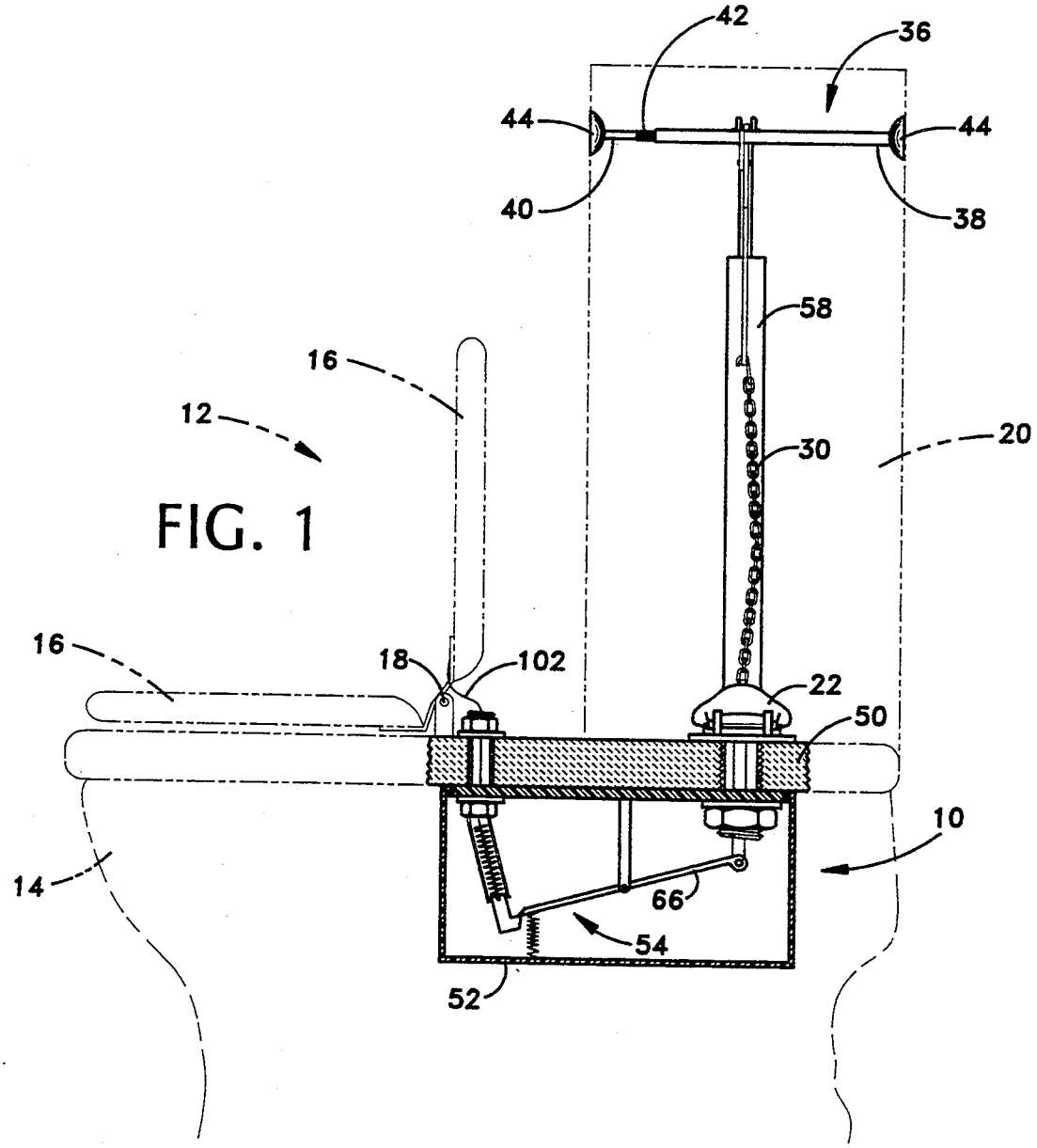
FIG. 1 is a right side elevational view of a toilet equipped with an automatic toilet flushing apparatus constructed according to the present invention, wherein the toilet is shown with the lid thereof in an open or lifted position.
Figure 2:
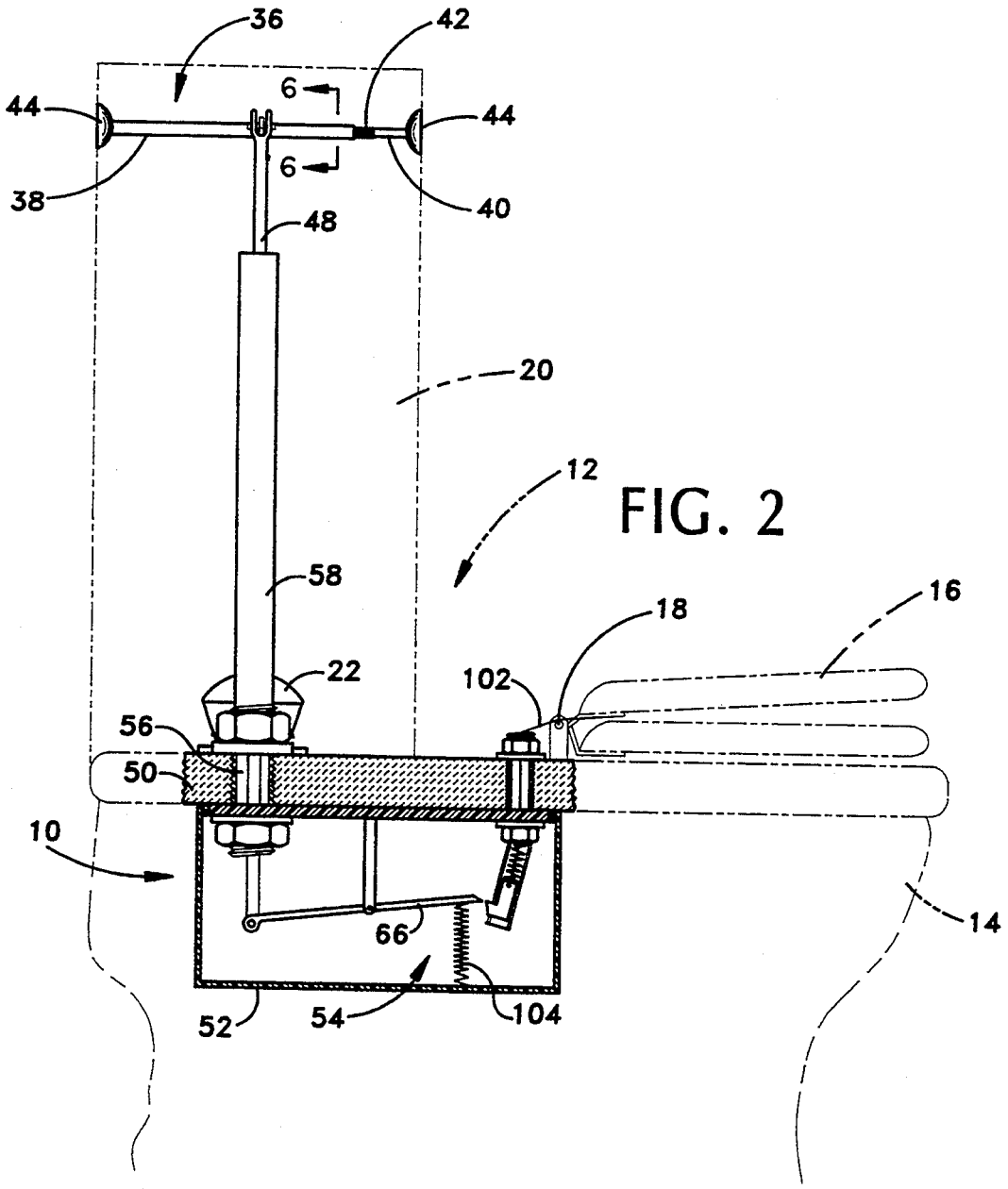
FIG. 2 is a left side elevational view of the toilet of FIG. 1, wherein the toilet is shown with the lid or cover being lowered into an almost closed position, and wherein the inventive toilet flushing apparatus is shown in a configuration just prior to being tripped and the initiation of a flushing action.
Figure 5:
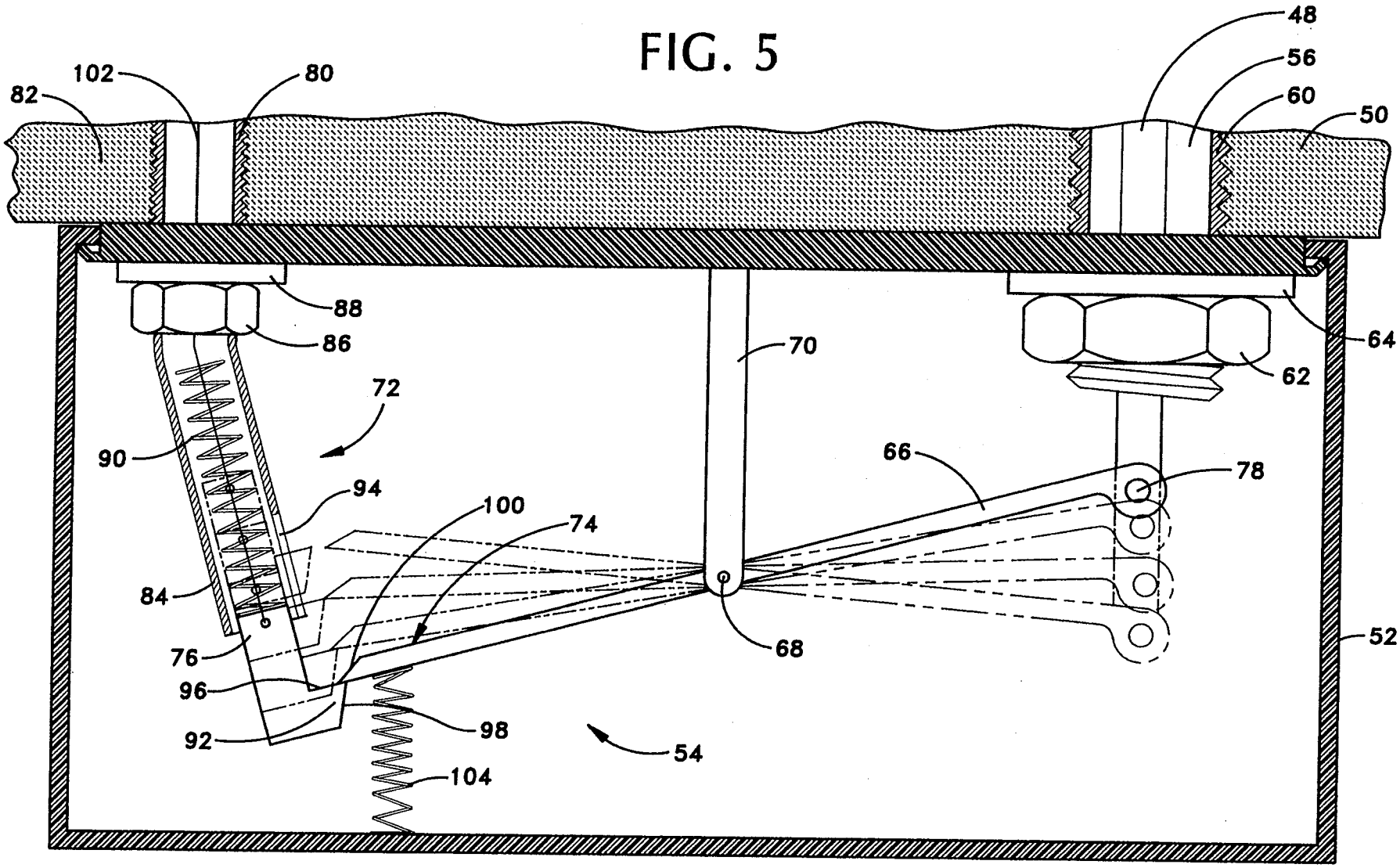
FIG. 5 is a detailed right side elevational view of a lever mechanism incorporated into the inventive toilet flushing apparatus, and including a number of phantom views showing the motion of the lever mechanism during a tripping action.
Figure 6:
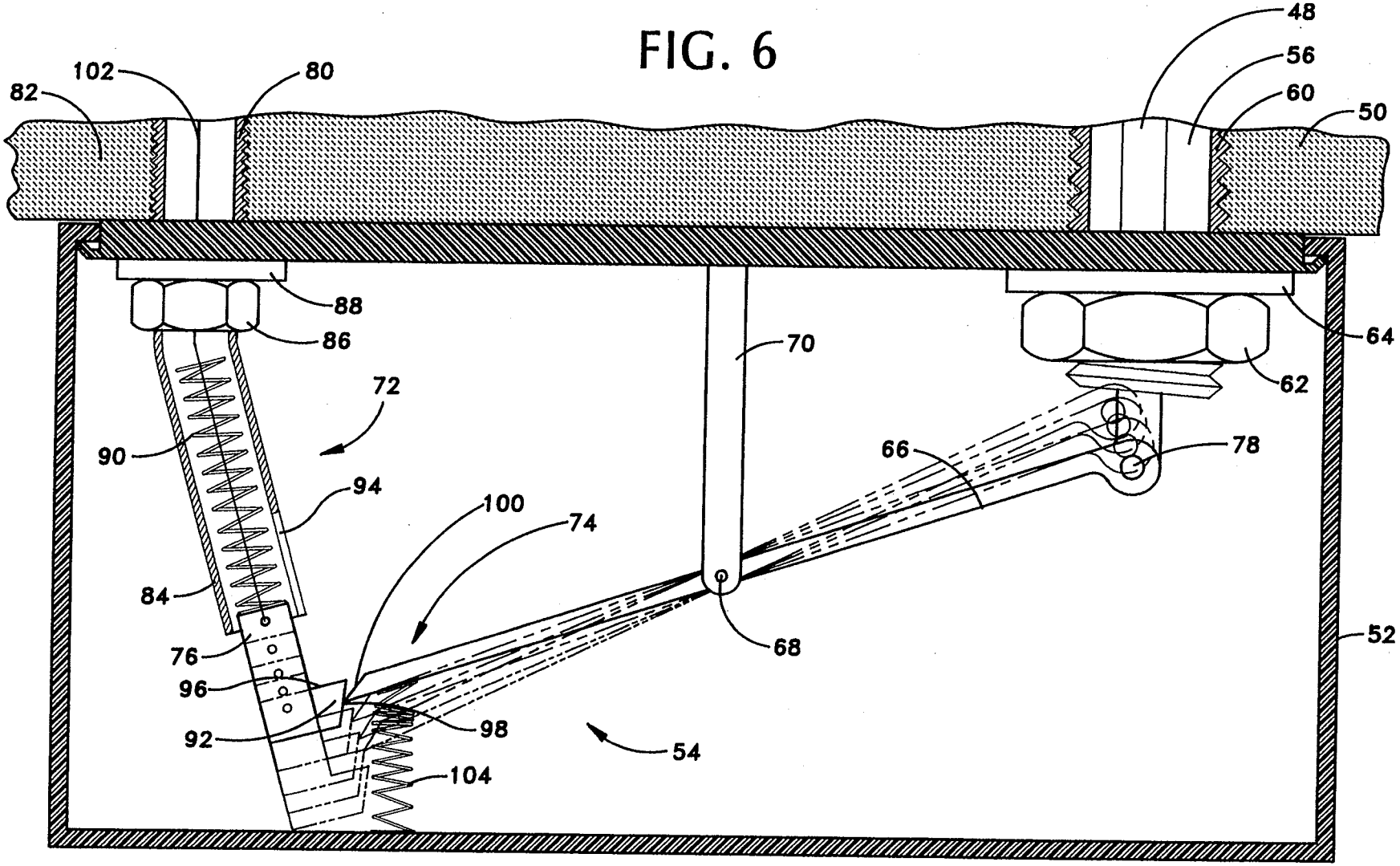
FIG. 6 is another detailed right side elevational view of a lever mechanism incorporated into the inventive toilet flushing apparatus, and including a number of phantom views showing the motion of the lever mechanism during a resetting action.
Figure 7:
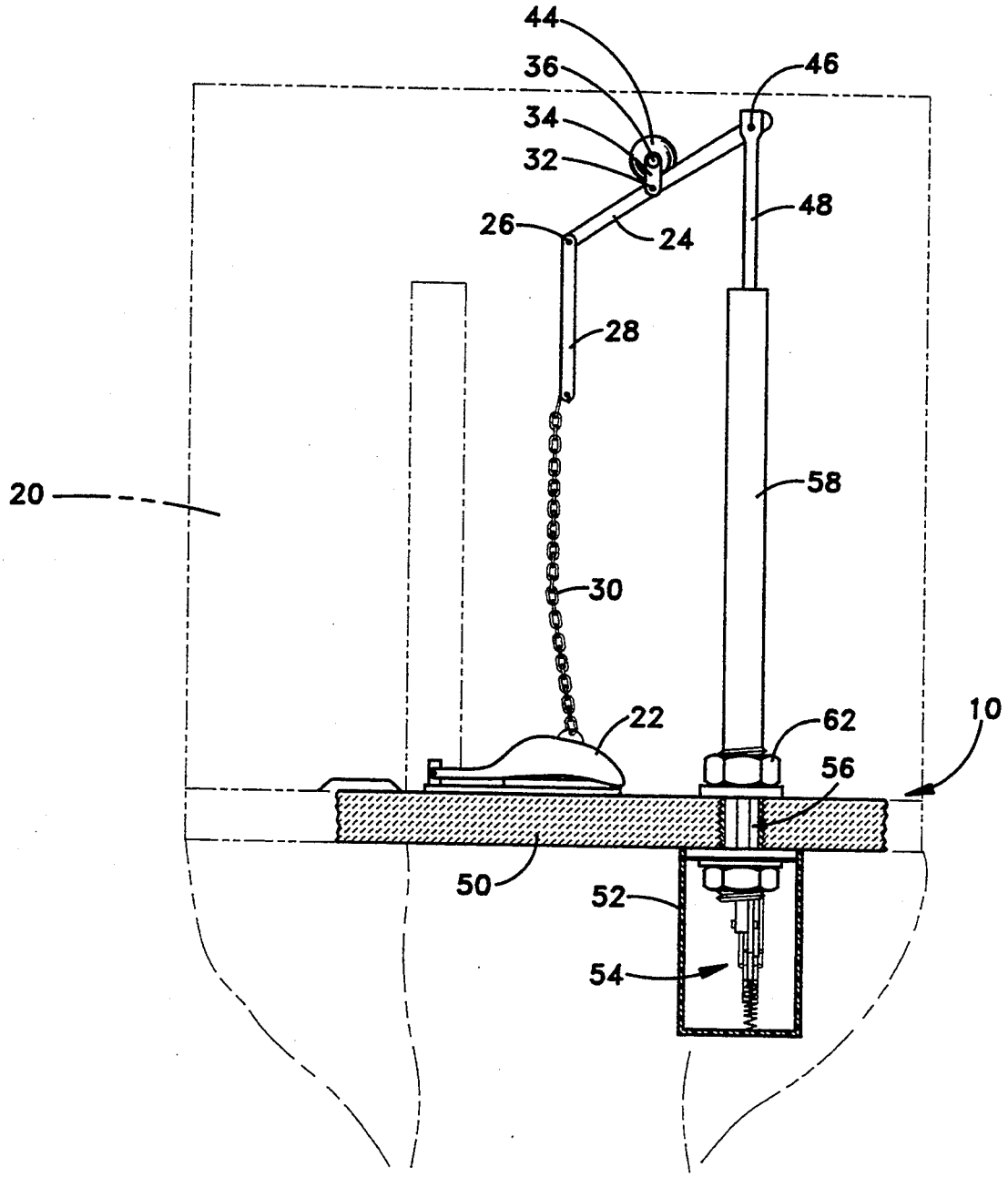
FIG. 7 is a rear elevational view of a toilet equipped with the inventive toilet flushing apparatus.
Figure 8:
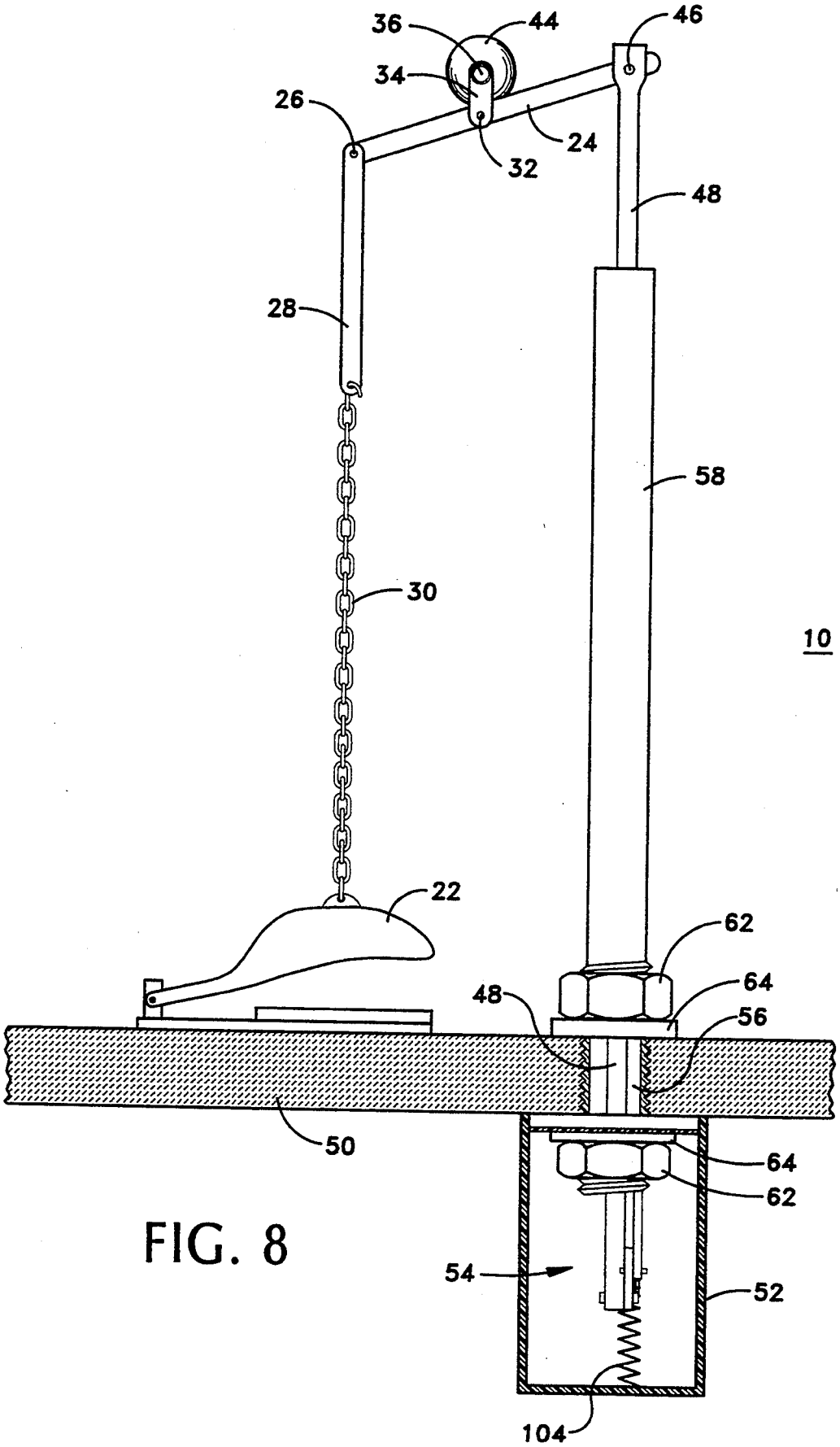
FIG. 8 is a rear elevational view of the inventive toilet flushing apparatus.

Referring now to all of FIGS. 1–7, an automatic toilet flushing apparatus 10 constructed according to the invention is provided on a conventional toilet 12 having a toilet bowl 14, a cover member 16 (e.g., a lid or cover) that is pivotally attached to the bowl 14 at a pivot point 18 and which is movable about the pivot point 18 between an open position (shown in FIG. 1) and a closed position, a water tank 20 that conventionally holds a supply of water for flushing the toilet 12, and a trippable flapper valve 22 that is normally in a down (or closed) position, as seen in FIGS. 1 and 6, but which can be tripped by raising the flapper valve 22 to an open position, as seen in FIGS. 2, 3, 4, and 7. As is conventional, tripping the flapper valve 22 to the open position allows the water contained in the water tank 20 to flow down into the bowl 14 thereby flushing the toilet 12. The water tank 20 is conventionally automatically refilled to an appropriate level through the provision of a float and valve mechanism well known in the art and therefore not shown or discussed further herein.

The automatic toilet flushing apparatus 10 according to the invention generally includes an actuating lever 24 that is positioned within the water tank 20 and which has a first terminal end 26 from which there is pivotally suspended a pivotal arm 28. The distal end of the pivotal arm 28 is connected by a link chain 30 to the flapper valve 22. The actuating lever 24 is pivotally connected at a fulcrum point 32 to a short connection member 34 that projects downward from an extensible rod member 36 that, as seen most clearly in FIG. 2, extends between the front and rear walls of the water tank 20. The extensible rod member 36 consists of first and second rod sections 38 and 40 which are threadingly connected at 42, the outer terminal ends of each of the first and second rod sections 38 and 40 having a suction cup 44 attached thereto. The extensible rod member 36 is positioned within the water tank in the approximate position shown and extended via the threaded connection 42 to bring the suction cups 44 in contact with the front and rear walls of the water tank 20, and the suction cups 44 then serve to support the extensible rod member 36.

A second terminal end of the actuating lever 24 is pivotally connected at 46 to a downwardly extending bar member 48 that passes through a bottom wall 50 of the water tank 20 and terminates in a housing 52 that is positioned beside the bowl 14. A tripping mechanism 54, described more fully below, is provided within the housing 52. The bottom wall 50 of the water tank 20 is provided with a throughgoing hole 56 through which the bar member 48 passes to reach the housing 52. To prevent any water from entering the housing 52, a vertical stand pipe 58 surrounds the bar member 48, the stand pipe 58 having an externally threaded section at 60 where it passes through the bottom wall 50. A pair of threaded nuts 62 and sealing washers 64 serve to support the stand pipe 58, clamp the housing 52 in place, and also prevent any leakage from the water tank 20.

The tripping mechanism 54 positioned within the housing 52 is shown in detail in FIGS. 5 and 6 and generally includes a tripping lever 66 which is pivotally mounted at a fulcrum point 68 on a support 70 that extends downward from the interior upper wall of the housing 52, a hollow tubular member 72 that also extends generally downward from the interior upper wall of the housing 52 and terminates adjacent a first end 74 of the tripping lever 66, and a catch member 76 that is disposed within the hollow tubular member 72 and that is free to move along the longitudinal axis thereof. A second end of the tripping lever 66 is pivotally connected at 78 to the bottom terminal end of the bar member 48.

The hollow tubular member 72 (e.g., a short section of pipe) is of dogleg shape (e.g., bent at an angle) and has a threaded upper section 80 which passes substantially vertically through a flange portion 82 of the toilet 12 that connects the bowl 14 to the water tank 20, and a lower section 84 that is inclined to the vertical and that projects into the housing, terminating adjacent the first end 74 of the tripping lever 66. Many conventional toilets are provided with such a structural portion 82, which is normally an extension of the rim of the bowl 14 that extends back therefrom and provides a support atop which the water tank 20 is mounted. The upper section 80 of the hollow tubular member 72 emerges from the flange portion 82 behind the cover member 16 and in front of the water tank 20, and is secured to the flange portion 82 by a pair of conventional nuts and washers 86 and 88, respectively.

Referring still to FIGS. 5 and 6, the catch member 76 is biased along the vertically inclined longitudinal axis of the lower section 84 of the hollow tubular member 72 and toward the bottom terminal end thereof by a coil spring 90 positioned behind the catch member 76. The catch member 76 has an outstanding projection 92 that projects outward from the lower section 84 through an elongated slit 94 provided thereon, the projection 92 having an upper engagement surface 96 that preferably is inclined upward in the direction toward the first end 74 of the tripping lever 66. The projection 92 is additionally is provided with another surface 98 which intersects with the engagement surface 96 and which is inclined inward toward the longitudinal axis of the hollow tubular member 72 from its point of intersection with the engagement surface 96. The first end 74 of the tripping lever 66 is provided with a tapered surface 100 that tapers inward in the direction of the distal portion of the first end 74.

Finally, the tripping mechanism 54 is completed by a trip wire 102 that extends from the catch member 76 to the cover member 16 of the toilet 12, and by the provision of a coil spring 104 that biases the tripping lever 66 in a clockwise direction of rotation about the fulcrum point 68.

Figure 3:
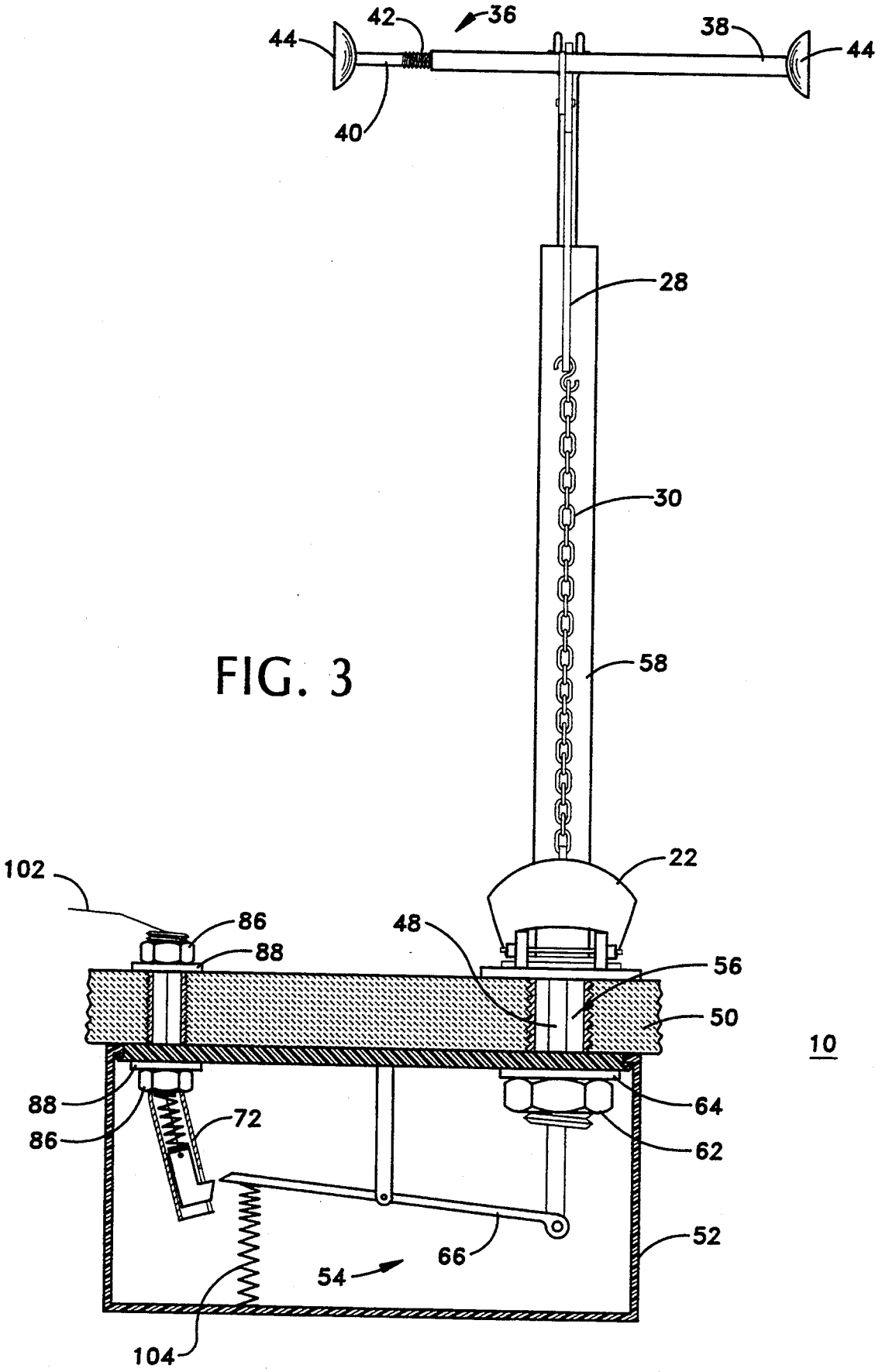
FIG. 3 is a right side elevational view of the inventive toilet flushing apparatus just prior to being tripped and the initiation of a flushing action.
Figure 4:
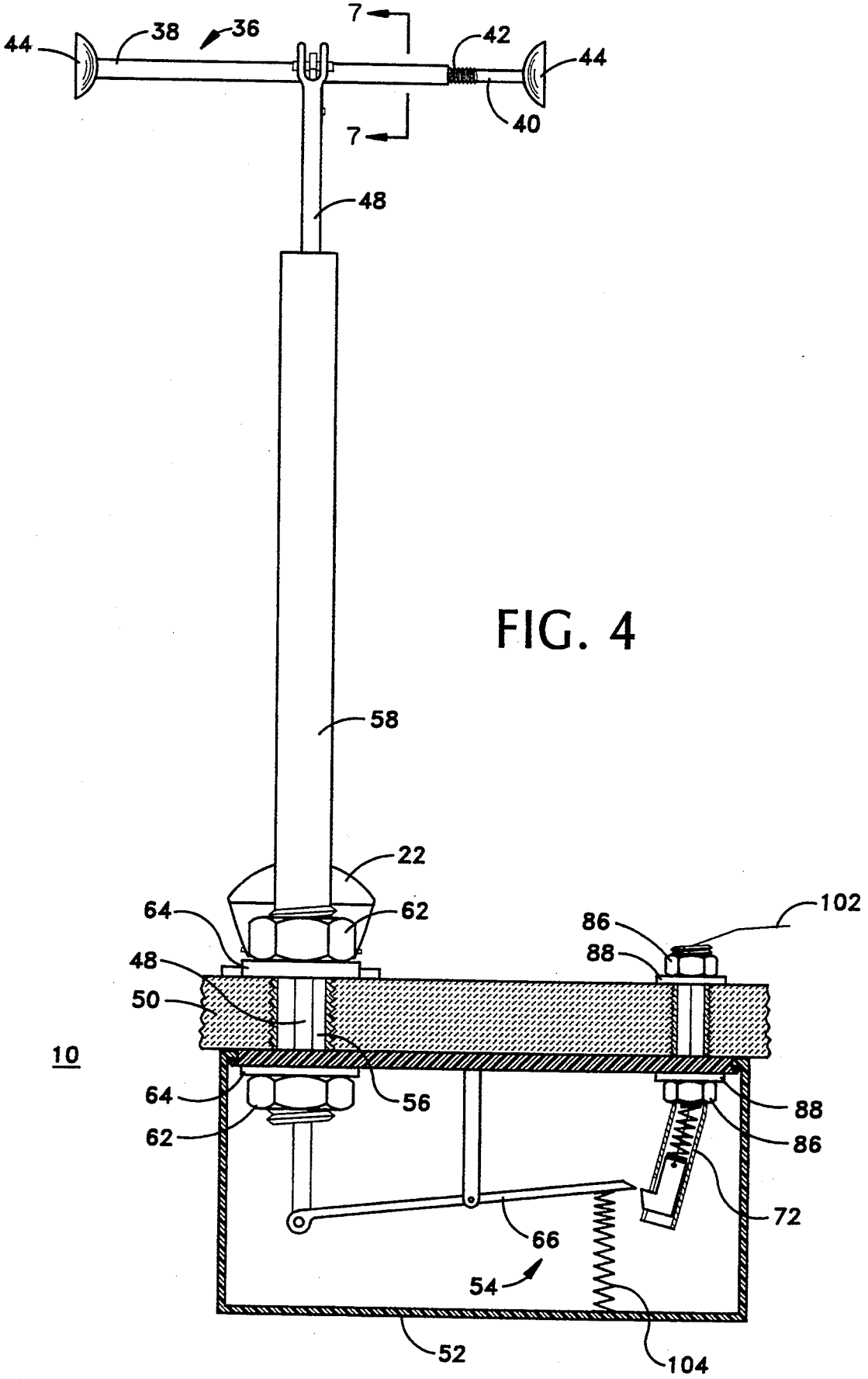
FIG. 4 is a left side elevational view of the inventive toilet flushing apparatus just prior to being tripped and the initiation of a flushing action.

The operation of the tripping mechanism 54 will be understood by a study of FIGS. 5 and 6, wherein there is shown, in solid lines, the normal rest positions of the catch member 76 and the tripping lever 66, as well as multiple phantom views illustrating the movement of the catch member 76 and the tripping lever 66 during a tripping action (FIG. 5) and a resetting action (FIG. 6). When the cover member 16 is lowered, the trip wire 102 raises the catch member 76 upward through the multiple phantom views shown in FIG. 5. The engagement surface 96 provided on the catch member 76 simultaneously raises the first end 74 of the tripping lever 66 which executes a clockwise pivoting movement about the fulcrum point 68 causing the second end 78 of the tripping lever 66 and the bar member 48 to be forced downward, resulting in a corresponding clockwise rotation of the actuating lever 24 and a lifting of the flapper valve 22, which causes a flushing of the toilet 10. The configuration of the inventive toilet flushing apparatus with the tripping lever 66 just before its most extreme degree of clockwise rotation is shown in FIG. 3, wherein the cover member 16 is shown in a nearly, but not quite, closed position. As the cover member 16 moves to a completely closed position, the catch member 76 is raised even further, to the uppermost phantom position shown in FIG. 5. At this point, the first end 74 of the tripping lever 66 slides off of the engagement surface and is rotated in a clockwise direction by the biasing action of the coil spring 104 back to the normal rest position shown in solid lines in FIGS. 5 and 6.

The cover member 16 may remain closed until the toilet 12 is to be next used. When the cover member 16 is again raised, the surface 98 provided on the projection 92 and the inwardly tapering surface 100 on the first end of the tripping lever 66 act as camming surfaces which produce a counterclockwise rotation of the tripping lever 66 to the most extreme degree of counterclockwise orientation shown in phantom in FIG. 6 (and a corresponding compression of the coil spring 104), at which point the first end 74 of the tripping lever 66 rotates clear of the surface 98 and the tripping lever is rotated back to the solid line rest position shown in FIGS. 5 and 6, thereby resetting the tripping mechanism 54 for the next subsequent actuation.

While the invention has been herein described by way of a particular preferred embodiment, various substitutions of equivalents may be effected without departing from the spirit and scope of the invention as set forth in the following claims.

What is claimed is:

1. An automatic toilet flushing apparatus for a toilet having a toilet bowl, a cover member for selectively moving between an open and a closed position with respect to the toilet bowl, a water tank, and a trippable flapper valve for admitting water from the water tank into the toilet bowl when the flapper valve is tripped, said automatic toilet flushing apparatus comprising:

an actuating lever pivotally mounted about a first fulcrum, said actuating lever having a first end and a second end;

a tripping lever pivotally mounted about a second fulcrum, said tripping lever also having a first end and a second end;

a first link connecting said first end of said actuating lever to the flapper valve;

a second link connecting said second end of said actuating lever to said second end of said tripping lever; and tripping means for initially pivoting said tripping lever about said second fulcrum and for thereafter releasing said tripping lever when the cover member is moved to the closed position with respect to the toilet bowl, said tripping means comprising:

a hollow member having a longitudinal axis;

a catch member disposed within said hollow member for sliding reciprocation therewithin along said longitudinal axis;

an outstanding projection provided on said catch member for engaging said first end of said tripping lever, said outstanding projection projecting outside of said hollow member;

a third link connecting said catch member and the cover member;

a spring positioned within said hollow member and urging said catch member along said longitudinal axis of said hollow member; and biasing means for biasing said tripping lever in a direction for applying tension to said first and second links.

2. An automatic toilet flushing apparatus according to claim 1, wherein said hollow member is provided with an elongated opening extending along said longitudinal axis, and wherein said outstanding projection of said catch member projects through said elongated opening to a point outside of said hollow member and adjacent said first end of said of said tripping lever.

3. An automatic toilet flushing apparatus according to claim 2, wherein said outstanding projection is provided with an upwardly facing engagement surface projecting substantially outward from said hollow member for engaging said first end of said tripping lever.

4. An automatic toilet flushing apparatus according to claim 3, wherein said actuating lever is positioned substantially above said tripping lever, wherein said longitudinal axis of said hollow member is oriented substantially obliquely to the vertical, and wherein a first camming surface is provided on said outstanding projection and a second camming surface is provided on said first end of said tripping lever.

5. An automatic toilet flushing apparatus according to claim 4, wherein said first camming surface comprises a surface extending inward toward said longitudinal axis of said hollow member from a point of intersection with said engagement surface and said second camming surface comprises an upwardly facing and inwardly tapering surface provided on said first end of said tripping lever.

6. An automatic toilet flushing apparatus according to claim 5, wherein said actuating lever is disposed within the water tank of the toilet.

7. An automatic toilet flushing apparatus according to claim 6, wherein said tripping lever is positioned substantially beneath the cover member of the toilet.

8. An automatic toilet flushing apparatus according to claim 7, wherein the water tank of the toilet includes a pair of opposing substantially vertical walls, and wherein said first fulcrum comprises:

a rod member for extending between the opposing walls of the water tank; and securement means for securing said rod member to the opposing walls of the water tank.

9. An automatic toilet flushing apparatus according to claim 8, wherein said securement means comprises a suction cup attached to each of the terminal ends of said rod member.

10. An automatic toilet flushing apparatus for a toilet having a toilet bowl, a cover member for selectively moving between an open and a closed position with respect to the toilet bowl, a water tank, the water tank including a pair of opposing substantially vertical walls, and a trippable flapper valve for admitting water from the water tank into the toilet bowl when the flapper valve is tripped, said automatic toilet flushing apparatus comprising:

an actuating lever pivotally mounted about a first fulcrum, said actuating lever having a first end and a second end;

a tripping lever pivotally mounted about a second fulcrum, said tripping lever also having a first end and a second end;

said actuating lever being positioned substantially above said tripping lever;

said actuating lever being disposed within the water tank of the toilet;

said tripping lever being positioned substantially beneath the cover member of the toilet;

said first fulcrum comprising a rod member for extending between the opposing walls of the water tank, said rod member comprising first and second rod sections, said first and second rod sections being threadingly interconnected, and a suction cup attached to each of the terminal ends of said rod member;

a first link connecting said first end of said actuating lever to the flapper valve;

a second link connecting said second end of said actuating lever to said second end of said tripping lever; and tripping means for initially pivoting said tripping lever about said second fulcrum and for thereafter releasing said tripping lever when the cover member is moved to the closed position with respect to the toilet bowl, said tripping means comprising:

a hollow member having a longitudinal axis;

said longitudinal axis of said hollow member being oriented substantially obliquely to the vertical;

an elongated opening extending along said longitudinal axis of said hollow member;

a catch member disposed within said hollow member for sliding reciprocation therewithin along said longitudinal axis;

a spring positioned within said hollow member and urging said catch member along said longitudinal axis of said hollow member;

an outstanding projection provided on said catch member for engaging said first end of said tripping lever, said outstanding projection projecting through said elongated opening to a point outside of said hollow member and adjacent said first end of said of said tripping lever;

said outstanding projection being provided with an upwardly facing engagement surface projecting substantially outward from said hollow member for engaging said first end of said tripping lever;

a first camming surface is provided on said outstanding projection, said first camming surface comprising a surface extending inward toward said longitudinal axis of said hollow member from a point of intersection with said engagement surface;

a second camming surface is provided on said first end of said tripping lever, said second camming surface comprising an upwardly facing and inwardly tapering surface provided on said first end of said tripping lever;

a third link connecting said catch member and the cover member; and biasing means for biasing said tripping lever in a direction for applying tension to said first and second links.

11. An automatic toilet flushing apparatus according to claim 10, wherein said first link comprises a chain.

12. An automatic toilet flushing apparatus according to claim 11, wherein said second link comprises a bar member pivotally connected to both of said second ends of said actuating and tripping levers.

13. An automatic toilet flushing apparatus according to claim 12, wherein said third link comprises a flexible cord extending between said catch member and the cover member of the toilet.

14. An automatic toilet flushing apparatus according to claim 13, wherein said first link additionally comprises an arm member pivotally connected to said first end of said actuating lever, said chain extending between said arm member and the flapper valve.

* * * * *